United States Patent [19]

Nemmer et al.

[11] Patent Number: 4,633,634

[45] Date of Patent: Jan. 6, 1987

[54] BUILDING SIDE WALL CONSTRUCTION AND PANEL THEREFOR

[76] Inventors: Albert E. Nemmer, 5371 Shimerville Rd.; Albert W. Nemmer, 5361 Shimerville Rd., both of Clarence, N.Y. 14031; Joseph E. Nemmer, 305 A. Audino La., Rochester, N.Y. 14624

[21] Appl. No.: 774,746

[22] Filed: Aug. 30, 1985

[51] Int. Cl.[4] ..... E04C 1/10

[52] U.S. Cl. ..... 52/474; 52/275; 52/281; 52/282; 52/601

[58] Field of Search ..... 52/601, 309.4, 238.1, 52/396, 309.16, 309.17, 309.7, 474, 475, 476, 477, 281, 282, 275

[56] References Cited

U.S. PATENT DOCUMENTS

| | | | |
|---|---|---|---|
| 1,639,577 | 8/1927 | Slater . | |
| 1,983,020 | 12/1934 | De Vol | 52/601 |
| 2,017,441 | 10/1935 | Kotrbaty | 72/115 |
| 3,192,671 | 7/1965 | Smith | 50/368 |
| 3,245,185 | 4/1966 | Rowe | 52/238.1 |
| 3,348,459 | 10/1967 | Harvey | 94/13 |
| 3,427,771 | 2/1969 | Cacossa | 52/262 |
| 3,512,819 | 5/1970 | Morgan et al. | 287/189.36 |
| 3,555,763 | 1/1971 | Bloxom | 52/396 |
| 3,604,169 | 9/1971 | Smith | 52/396 |
| 3,631,644 | 1/1972 | Mazza | 52/309.4 |
| 3,638,384 | 1/1972 | Martin | 52/601 |
| 3,866,381 | 2/1975 | Eschbach et al. | 52/731 |
| 3,995,402 | 12/1976 | Parenteau | 52/241 |

*Primary Examiner*—James L. Ridgill, Jr.
*Attorney, Agent, or Firm*—Joseph P. Gastel

[57] ABSTRACT

A building side wall construction including a plurality of expanded polystyrene panels placed edge-to-edge and connected by connecting studs each comprising a pair of C-shaped channels fastened in back-to-back relationship with each C-shaped channel being received in complementary mating relationship in grooves of the adjacent panels, and central reinforcing channels received in mating slots at central portions of the panels, with the opposite ends of the connecting studs and the central reinforcing studs being fastened to lower and upper channels in which they are received.

27 Claims, 10 Drawing Figures

BUILDING SIDE WALL CONSTRUCTION AND PANEL THEREFOR

BACKGROUND OF THE INVENTION

The present invention relates to an improved building side wall construction.

By way of background, building side wall structures utilizing panels connected to each other are known. However, prior structures were relatively complex.

SUMMARY OF THE INVENTION

It is one important object of the present invention to provide a highly simplified side wall building structure.

Another object of the present invention is to provide an outer wall construction for a building utilizing lightweight expanded plastic panels which are reinforced in an unique manner against loads normally experienced in use.

A further object of the present invention is to provide an improved side wall structure for a building in which the load-bearing studs which also connect panels are fabricated from conventional commercially obtainable materials.

Yet another object of the present invention is to provide an improved expanded plastic panel of a configuration which can be assembled with associated studs in an extremely simple and expedient manner. Other objects and attendant advantages of the present invention will readily be perceived hereafter.

The present invention relates to a building side wall construction comprising a bottom channel having a first horizontal web and first legs extending upwardly therefrom, a plurality of expanded plastic panels having inner and outer faces and opposite end portions and opposite vertical side edge portions, connecting studs for connecting said opposite side edge portions to each other, each of said connecting studs comprising a pair of C-shaped channels having second webs and second legs extending outwardly therefrom with said second webs being secured to each other in fixed back-to-back relationship, and elongated slots in said side edge portions for receiving said second legs in substantially complementary mating relationship, said second legs of said C-shaped channels having outer end portions remote from said second webs which extend transversely to said second legs, and bottom end portions on said connecting studs received in said bottom channel.

The present invention also relates to a building wall corner construction comprising first and second horizontal lower channels joined perpendicularly to each other and having first and second channel webs, respectively, and first and second channel legs, respectively, extending upwardly therefrom, first and second expanded plastic panels oriented perpendicularly to each other and each having an inner face and an outer face and a thickness which is greater than the spacing between said channel legs of said first and second channels, and a corner stud for joining said first and second panels, said corner stud comprising a first generally C-shaped channel having a first C-channel web and first C-channel legs extending outwardly therefrom, first and second side edges on said first and second panels, respectively, first groove means in said first side edge for receiving at least one of said first C-channel legs, a second C-shaped channel having a C-channel web and second C-channel legs extending outwardly therefrom, said second C-channel web extending substantially perpendicularly to said first C-channel web with one of said second C-channel legs being secured to said first C-channel web, and second groove means in said second panel for receiving said second C-channel web and one of said second C-channel legs.

The present invention also relates to a building panel comprising a body of expanded plastic having an inner face and an outer face, opposite edge portions on said body, opposite end portions on said body, a first elongated groove in each of said opposite edge portions, each of said first elongated grooves having a first portion which extends inwardly into said body in a first direction and a second portion in communication with said first portion and extending transversely thereto, and a second elongated groove in each of said end portions, said first and second grooves defining a substantially continuous groove about said body.

The various aspects of the present invention will be more fully understood when the following portions of the specification are read in conjunction with the acompanying drawings wherein:

DESCRIPTION OF THE PREFERRED EMBODIMENTS

Figure 4:
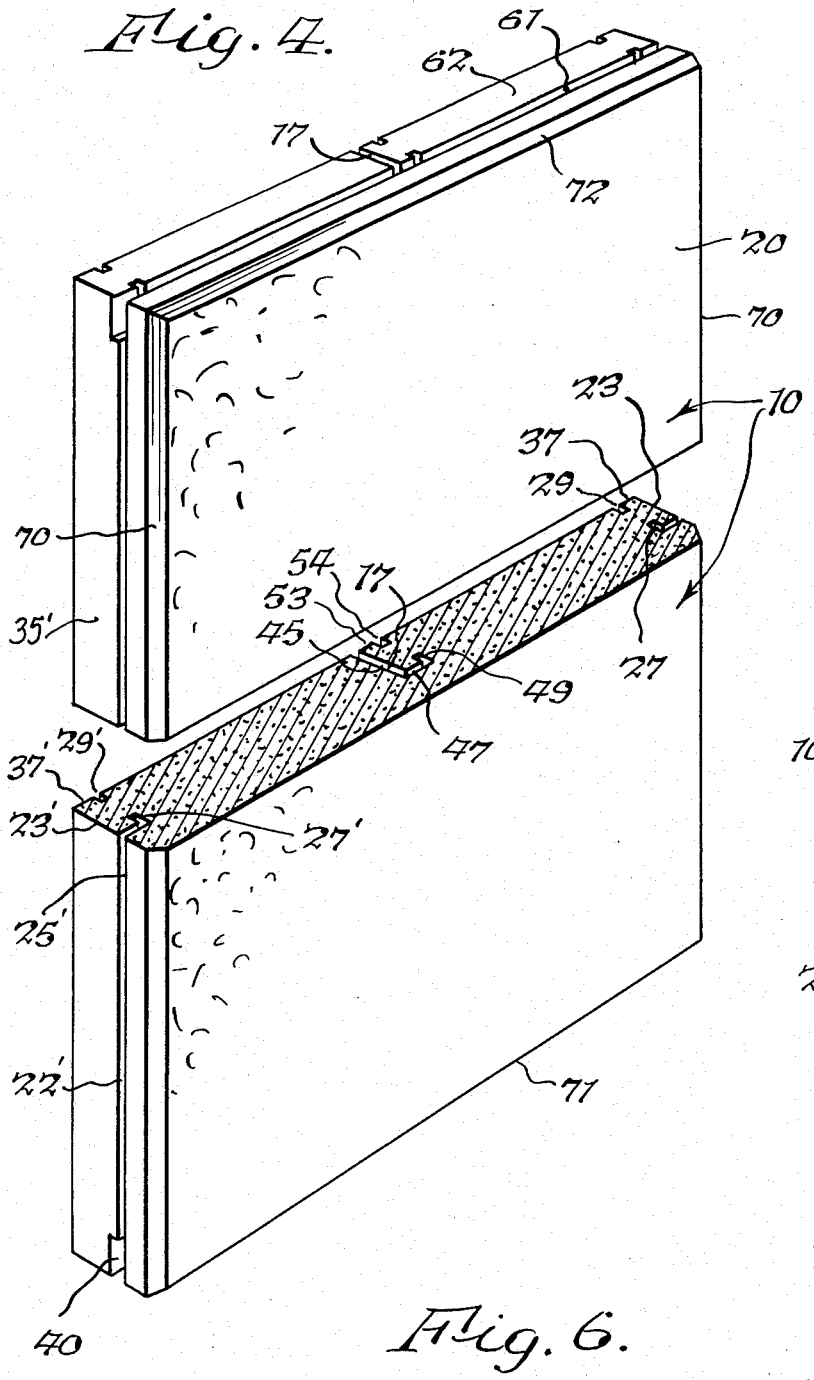
FIG. 4 is a perspective view, partially broken away of an expanded plastic panel without its associated studs.
Figure 6:
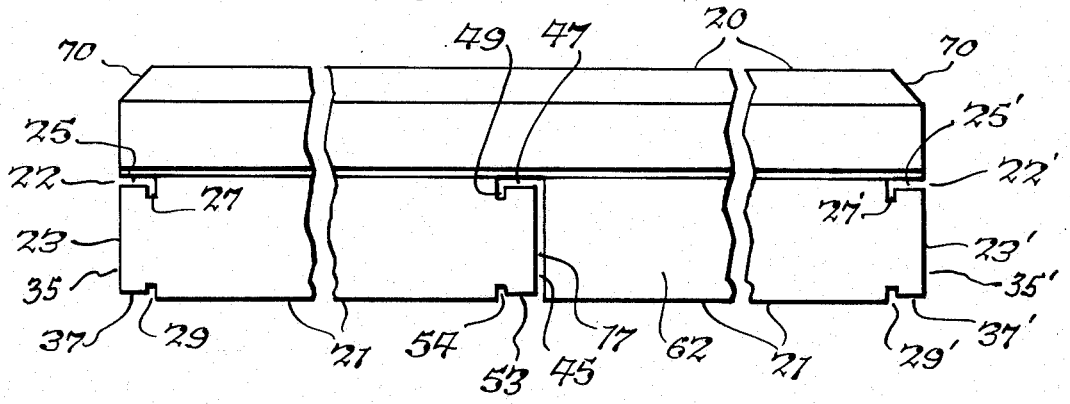
FIG. 6 is a fragmentary plan view of the panel of FIG. 4.

Summarizing briefly in advance, the improved building side wall construction consists of a plurality of expanded plastic panels 10 joined to each other by load-bearing studs 11 which have their lower ends anchored in a C-shaped channel 12 by means of suitable connectors, such as metal screws 13, and which have their upper ends received in channel 14 and secured thereto by suitable fasteners, such as metal screws 15. A panel-reinforcing C-shaped channel member 16 is suitably received within a mating groove 17 (FIGS. 4 and 6) and has its lower end received in channel 12 and secured thereto by a suitable connector, such as a metal screw 17. The upper end of panelreinforcing channel 16 is received in channel 14 and secured thereto by a suitable connector, such as metal screw 19.

Each panel 10 (FIGS. 4, 5 and 6) is fabricated of expanded polystyrene and it has an outer surface 20 which faces the outside of the building and an inner surface 21 which faces the inside of the building. Elongated slots 22 and 22', which are mirror images of each other, are formed, as by "hot-wiring," in the sides 23 and 23', respectively, of panel 10. Slots 22 and 22' have first portions 25 and 25', respectively, which extend inwardly substantially perpendicularly to sides 23 and 23', respectively. At the ends of slot portions 25 and 25' are slot portions 27 and 27', respectively, which extend perpendicularly thereto. Slots 29 and 29' extend inwardly in a substantially perpendicular direction from inner face 21 into panel 10. Slots 29 and 29' are in line with slot portions 27 and 27', respectively.

Figure 7:
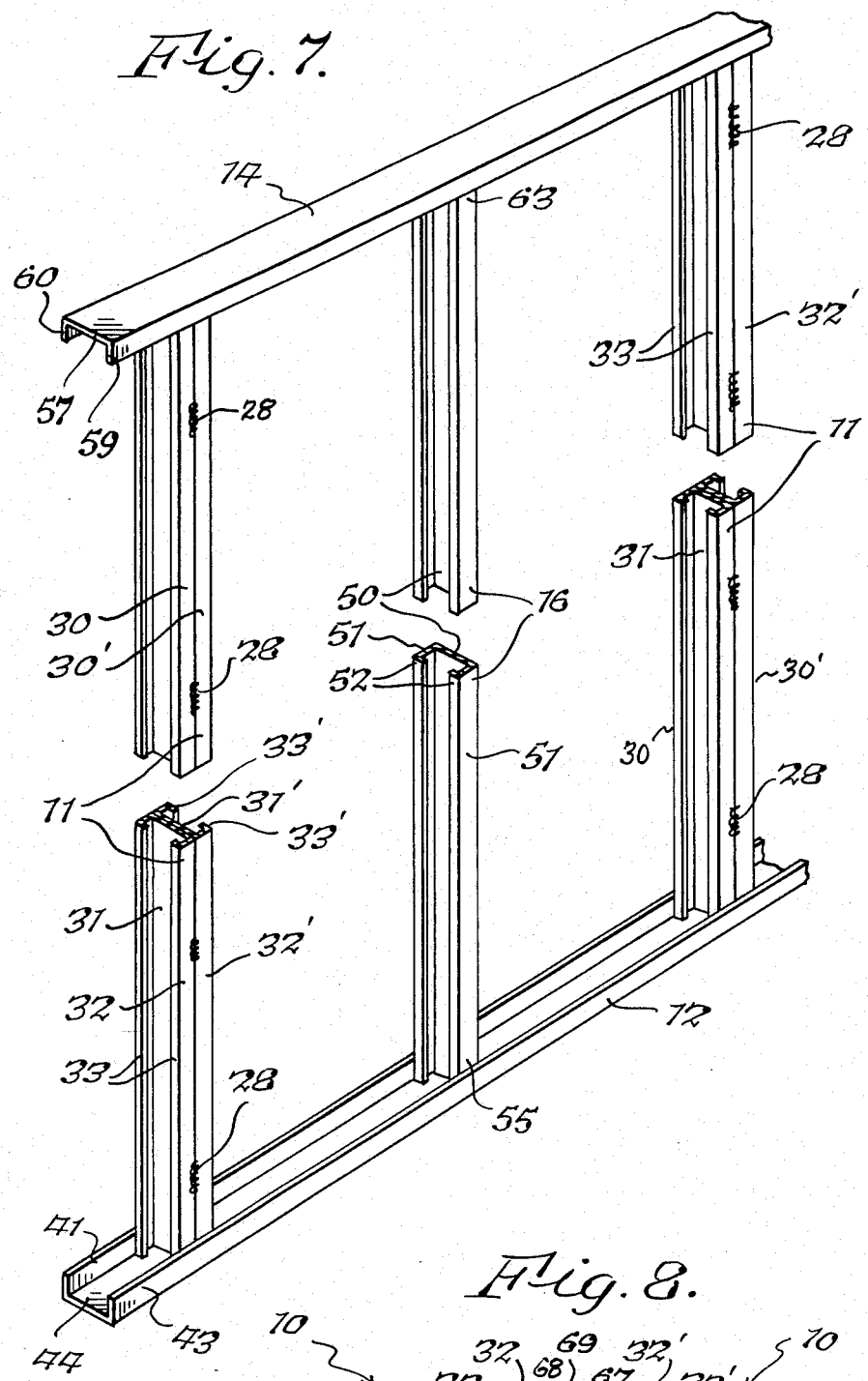
FIG. 7 is a fragmentary perspective view of the C-shaped channels associated with the plastic panels and shown in relationship to their associated supporting channels.

The above described slots associated with opposite sides 23 and 23' of each panel receive one side of each stud 11, the adjacent side of each stud 11 being received in an adjacent panel. Each stud 11 (FIG. 7) comprises a pair of C-shaped channels 30 and 30' which have their webs 31 and 31', respectively, permanently attached thereto by spaced spot-welds 28 or by any other suitable form of connection. Legs 32 and 32' extend outwardly in opposite directions from webs 31 and 31', respectively. At the outer ends of legs 32 and 32' are transversely extending portions 33 and 33', respectively, which extend toward each other.

Studs 11 are mounted in complementary mating relationship with sides 23 and 23' of panels 10. More specifically, each channel 30' has its web 31' positioned in abutting relationship with portion 35 of side 23. One leg 32' is received in complementary mating relationship in slot 25 with its outer transverse end 33' received in slot portion 27. The other leg 32' has a portion abutting surface 27 of face 21 and its outer transverse end 33' received in slot 29. The adjacent channel 30 of stud 11 has its web 31 located in abutting relationship to portion 35' of side edge 23'. One leg 32 is received in complementary mating relationship in slot portions 25' and 27'. The other leg 32 abuts surface 37' of face 21 and its transverse end 33 is received in slot 29'. Surfaces 37 and 37' are recessed relative to the remainder of face 21 so that the outer surfaces of channel legs 32 and 32' lie flush with face 21.

Figure 1:
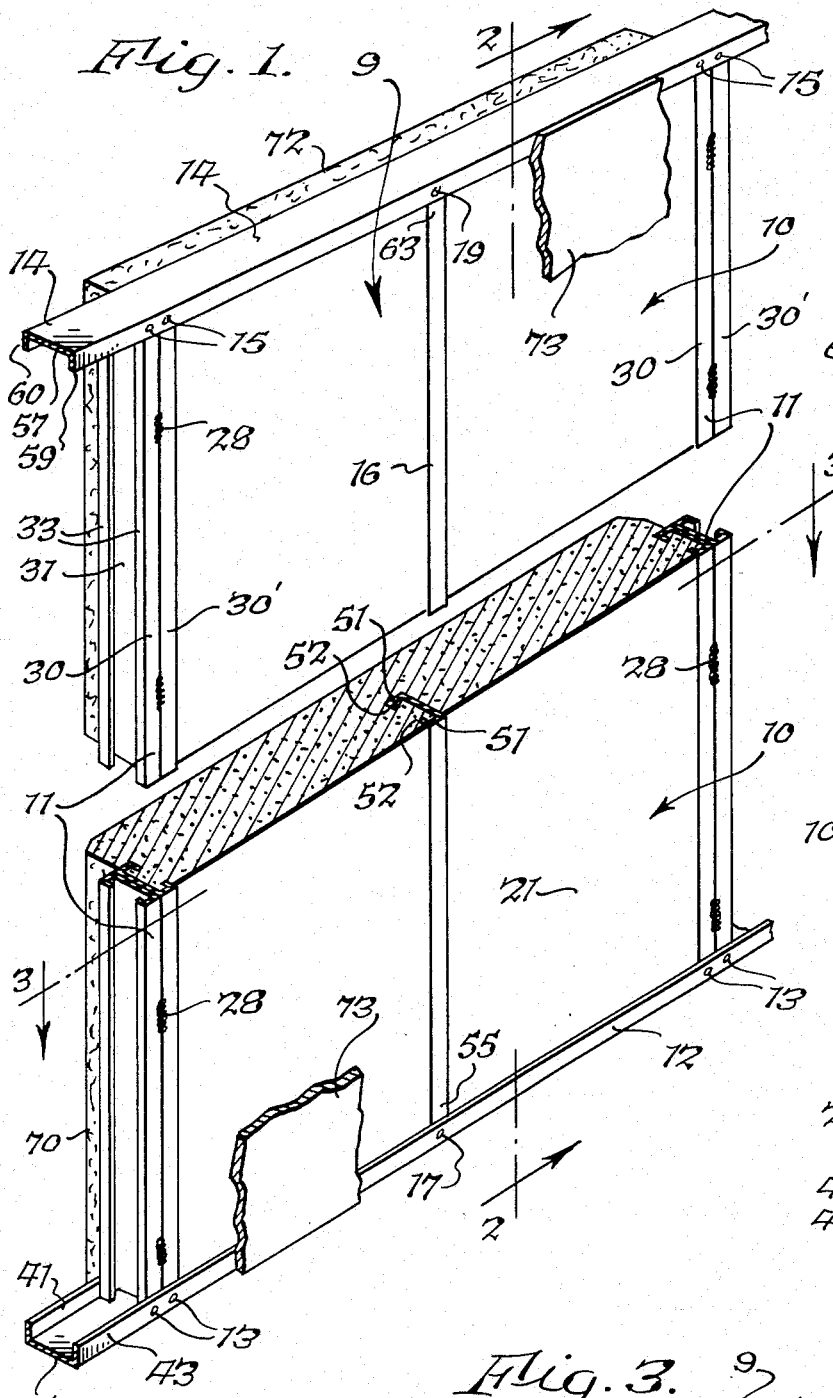
FIG. 1 is a fragmentary perspective view, partially broken away, of an expanded plastic panel assembled with its associated C-shaped studs having opposite ends secured to transversely extending channels.

A wall 9 is constructed in the following manner. A panel 10 with two studs 11 in place, as described above, on the opposite sides 23 and 23' is positioned in channel 12 as shown in FIG. 1. Thereafter, an adjacent panel 10 is slid vertically downwardly onto the exposed side of a stud 11 so that the channel is received in mating relationship relative to the side portion of the new panel which is being installed. The foregoing procedure is followed until a desired length of wall 9 is built up.

Figure 2:
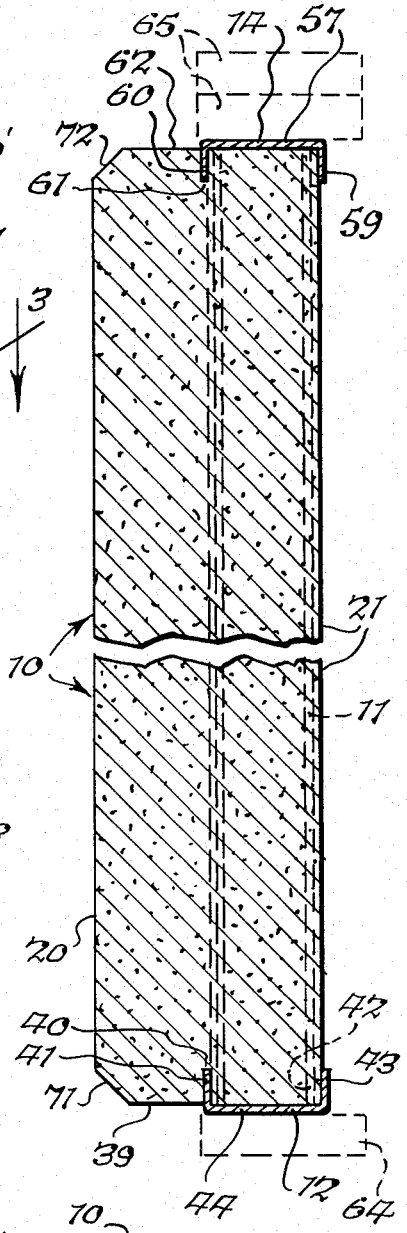
FIG. 2 is a fragmentary cross sectional view taken substantially along line 2—2 of FIG. 1.
Figure 5:
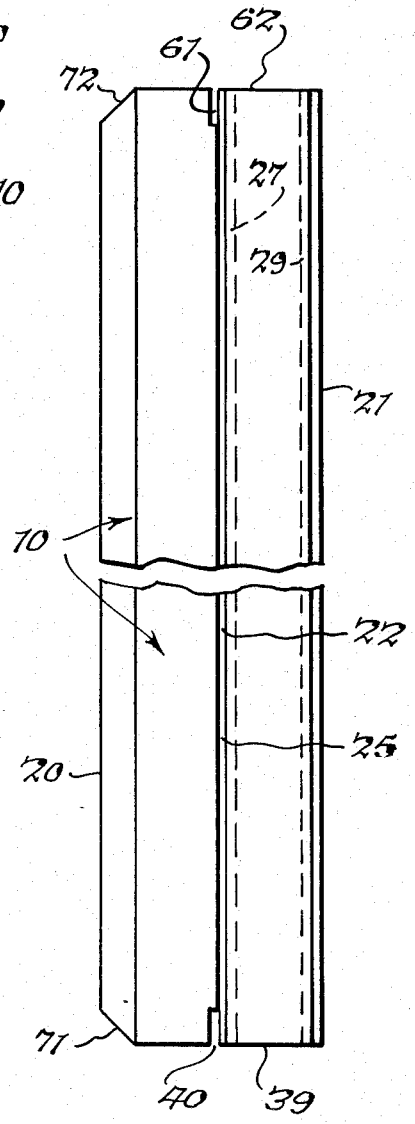
FIG. 5 is a fragmentary side elevational view of the panel of FIG. 4.

As can be seen from FIGS. 2 and 5, the bottom edge 39 of each panel 10 has a slot 40 therein which receives the upstanding leg 41 of lower channel 12. It can also be seen from FIG. 2 that the lower ends 42 of studs 11 are received between upstanding legs 41 and 43 of channel 12 which extend upwardly from its web 44. As noted previously, once studs 11 are in place, they are secured to leg 43 of channel 12 by means of connecting members 13, which may be metal screws.

In order to reinforce each panel 10, which may have a dimension of 4 feet by 8 feet, a central supporting stud 16 is provided. In this respect a slot 17 (FIG. 6) is hot-wired into panel 10. Slot 17 includes a portion 45 which extends substantially perpendicularly to face 21 and which merges with transversely extending slot portion 47, which merges with transversely extending slot portion 49. Reinforcing stud 16 is of generally C-shaped configuration and includes a web 50 having legs 51 extending from opposite sides thereof. Transversely extending ends 52 extend inwardly from legs 51. Supporting studs 16 are slid longitudinally into slot 17 of each panel 10. The web 50 is received in slot portion 45 and one leg 51 with its transverse end 52 is received in slot portions 47 and 49. The other leg 51 of each supporting stud is in abutting relationship with face portion 53 and the outer transverse end 52 of leg 51 is received in slot 54 which extends inwardly from face 21. The lower end 55 of stud 16 is received between legs 41 and 43 of lower channel 12 and a suitable connector, such as metal screw 17, is driven through leg 43 into one of the legs 41 of supporting stud 16. Face portion 53 is recessed relative to the remainder of face 21 by an amount which is equal to the thickness of leg 51 so that the outer surface of leg 51 lies flush with face 21.

After a plurality of expanded plastic panels 10 with their associated studs 11 and supporting studs 16 have been assembled into lower channel 12, an upper channel 14 (FIGS. 1 and 7) is installed. Upper channel 14 includes a web 57 and downwardly extending legs 59 and 60. Leg 60 is received in groove 61 in upper edge 62 of panel 10. As can be seen from FIG. 5, grooves 40 and 61 lie in the same plane which is offset from the plane in which grooves 22 and 22' lie. The upper ends 63 of supporting studs 16 are received in channel 14 and a suitable fastener, such as screw 19, is driven through leg 59 of channel 57 and into leg 51 of supporting stud 16. As noted above, screws 15 connect leg 59 to the upper ends of studs 11.

As can be seen from FIG. 2, bottom channel 43 rests on and is suitably secured to a plate 64 which is suitably affixed to the foundation of a building. Top plates, such as 65, rest on web 57 of top channel 14.

Figure 3:
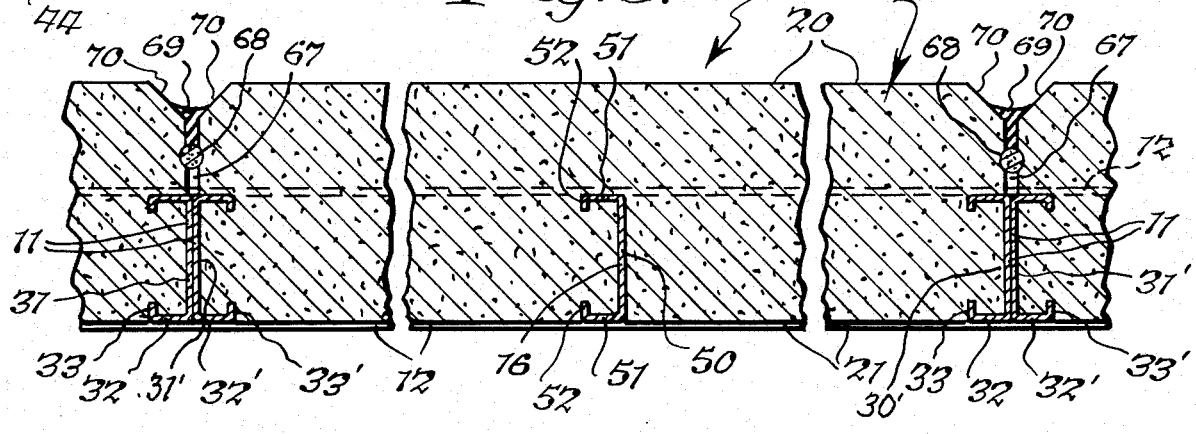
FIG. 3 is a fragmentary cross sectional view taken substantially along line 3—3 of FIG. 1.
Figure 8:
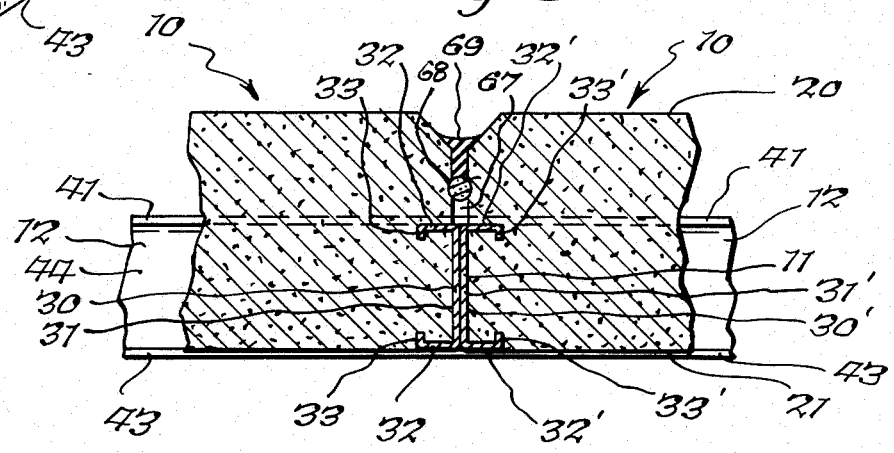
FIG. 8 is a fragmentary cross sectional view similar to FIG. 3 but showing the manner in which adjacent plastic panels are joined by the backed C-shaped studs and also showing the caulking between the adjacent panels at their outer edges.

Because of the width of webs 31 and 31' of studs 11 and further because of the geometry of panels 10, spaces 67 (FIGS. 3 and 8) will exist between the sides of adjacent panels 10. Therefore, a polystrene rope packing 68 and suitable caulking 69 is applied to the seams between adjacent panels. At this point it is to be noted that the side edges of the panels are beveled at 70 and the lower edges are beveled at 71 and the upper edges are beveled at 72.

Suitable wallboard 73 or the like is mounted adjacent the inner surfaces 21 of panels 10. The lower edges of wallboard panels 73 overlie leg 43 of lower channel 12 and the upper edges of panels 73 overlie leg 59 of upper channel 14. When channel legs 43 and 59 are less than 3/16 inches thick, the wallboard 73 can bear directly on these members and on the adjacent portions of studs 11 and 16. However, if channel legs 43 and 59 are thicker than 3/16 inches, suitable shims or spacers should be provided on studs 11 and 16 to cause their effective outer surfaces to lie in the same plane as the outer surfaces of legs 43 and 59 to properly support wallboard 73.

Figure 9:
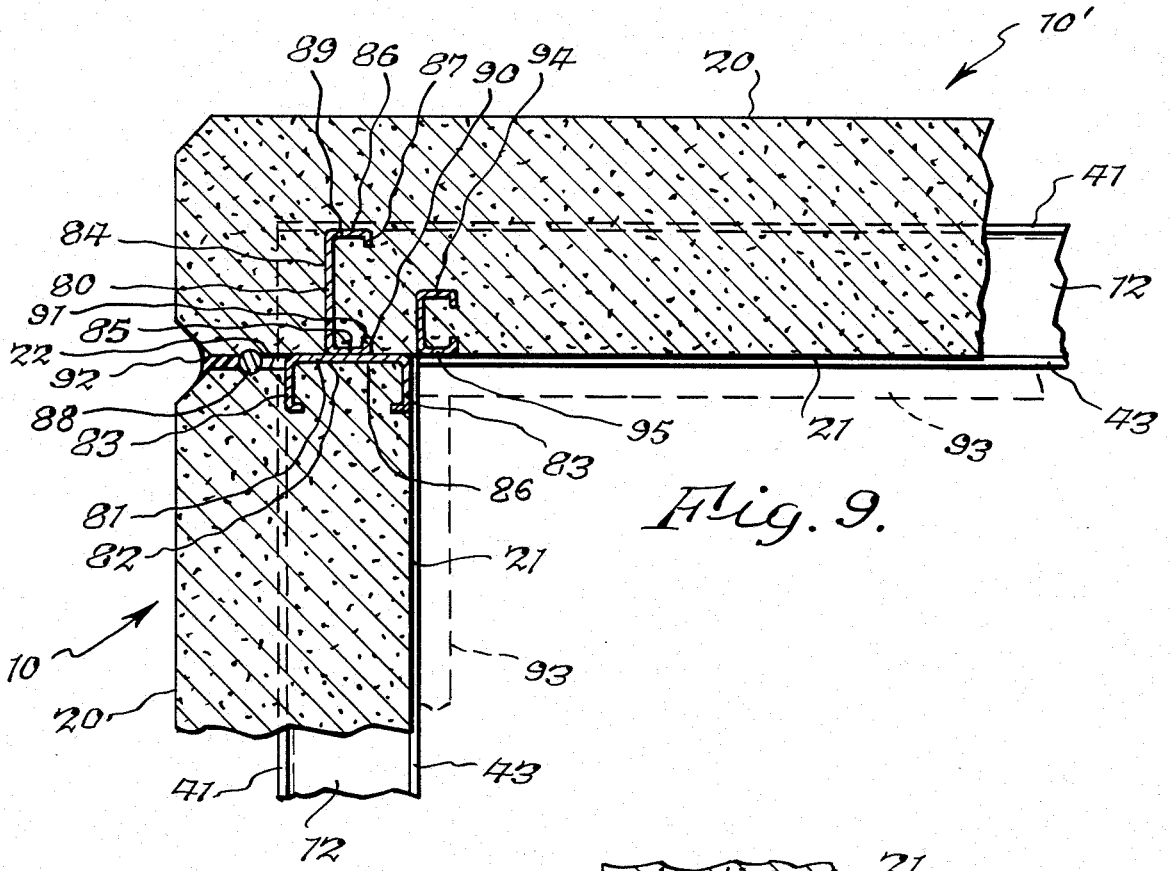
FIG. 9 is a fragmentary cross sectional view taken generally along a horizontal section line, such as 3—3 of FIG. 1, but showing the construction at a corner joint where two panels meet at substantially right angles to each other.

In FIG. 9 a typical corner joint is shown. At this corner joint, one conventional panel 10, as described above, is used. However, a modified panel 10' must also be used in order to obtain the corner configuration shown. In the corner construction of FIG. 9 a stud 80 is used. Stud 80 includes a first C-shaped channel 81 having a web 82 and legs 83. Channel 81 is associated with side edge 86 of panel 10 in the same manner as described above in the preceding figures. However, stud 80 differs from studs 11 in that it has a second C-shaped channel 84 which has one leg 85 secured to web 82. A slot is hot-wired into panel 10' to receive web 84 and portions 86 and 87 of leg 89. In addition, a slot 90 is provided in panel 10' to receive leg portion 91 of channel 84. The surface on which leg 85 rests is recessed so that the outer surface of leg 85 lies flush with the remainder of the surface of panel 10'. The two panels 10 and 10' are assembled relative to each other in generally the same manner as the panels 10 of a side wall. In this respect, for example, after panel 10 is in place, in the frame consisting of two bottom channels 12, the C-shaped channel 81 of supporting stud 80 is slid downwardly into the slots in the edge 22 of panel 10. Thereafter, panel 10' is slid downwardly to receive C-shaped channel 84 of stud 84 of stud 80 in the suitable hot-wired slot portions therein. After panels 10 and 10' have been assembled with each other, suitable polystyrene rope packing 88 and caulking 92 is applied at the joint.

Wallboard panels 93 are applied in contiguous relationship to the inner surfaces of panels 10 and 10' in the manner described above relative to panels 73 (FIG. 3A). However, in order to provide an anchor for one of the panels 93, a C-shaped supporting stud 94 is installed in panel 10' as shown in FIG. 9. Stud 94 extends throughout the entire length of the panel and its opposite ends are received in upper and lower channels 14 and 12, respectively. The outer surface of leg 95 of channel 94 lies in the same plane as the surface of panel 10', that is, it lies in the same plane as the outer surface of leg 85 of channel 84. Therefore, the portion of the surface of the panel underlying leg 95 is cut away so that the outer surface of leg 95 can lie flush with the remainder of the surface of the panel. The outer surfaces of legs 85 and 95 will also lie in the same plane as the outer surfaces of studs 11 and 16 which are associated with the wall in which corner panel 10' is located. If the thickness of channel leg 43 exceeds 3/16 of an inch, a spacer is positioned between web 81 and channel leg 85, and suitable spacers are also mounted on the outer legs of studs 11 and 16 to provide proper bearing surfaces for the wallboard 93.

Figure 10:
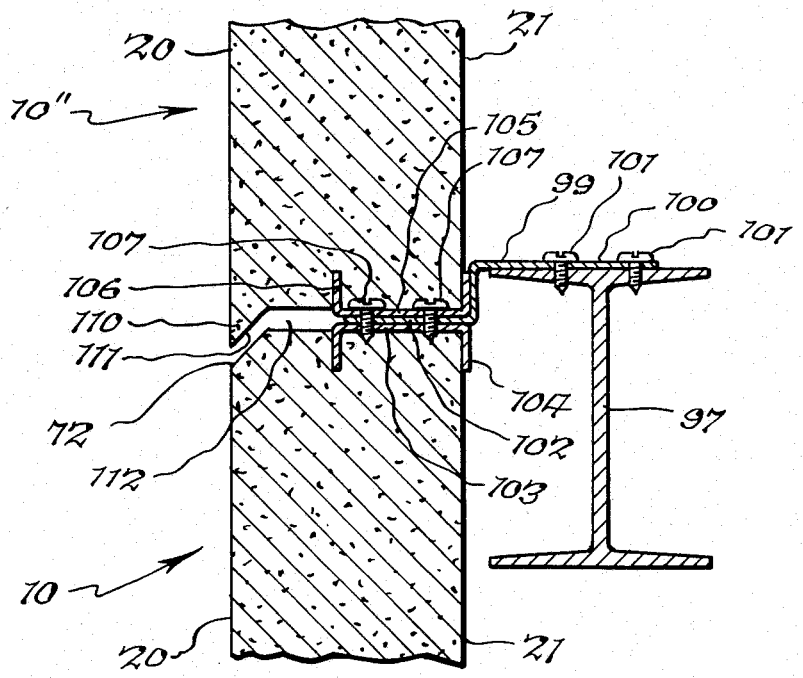
FIG. 10 is a fragmentary cross sectional view taken along a vertical line, such as 2—2 of FIG. 1, and showing the structure for mounting additional panels above lower panels.

In FIG. 10 a side wall construction is shown wherein the wall is a plurality of panels high. In order to achieve the foregoing a special joint is provided between the upper edge of lower panel 10 and lower edge of upper panel 10''. In this regard, the building girder 97 is shown. Angle 99, of the shape shown in FIG. 10, has leg 100 secured to the upper end of I-beam 97 by screws 101. The lower leg 102 of angle 100 is received between the web 103 of channel 104 and the web 105 of channel 106. Fasteners 107 secure the foregoing parts to each other as shown. Channel 104 is analogous to upper channel 14. Channel 106 is analogous to lower channel 12. The lower panel 10 has its upper edge beveled at 72, as shown in all the drawings. However, the lower edge of upper panel 10'' has a configuration, such as shown at 110, with a side 111 which lies parallel to bevel 72. This prevents rain water from entering space 112. If desired, caulking may be applied between bevel 72 and surface 111.

Any desired type of finish, such as stucco or exterior paint or any other type of surface, may be applied to the outer surfaces 20 of panels 10. Furthermore, panels 10 may be made in any desired thickness to meet different climate conditions. The studs 11 may also vary in size to meet different loading conditions.

While preferred embodiments of the present invention have been disclosed, it will be appreciated that the present invention is not limited thereto but may be otherwise embodied within the scope of the following claims.

What is claimed is:

1. A building side wall construction comprising a bottom channel having a first horizontal web and first legs extending upwardly therefrom, a plurality of rigid expanded plastic panels having inner and outer faces and opposite end portions and opposite vertical side edge portions, connecting studs for connecting said opposite side edge portions to each other, each of said connecting studs comprising a pair of C-shaped channels having second webs and second legs extending outwardly therefrom with said second webs being secured to each other in fixed back-to-back relationship, and elongated slots in said side edge portions for slidably receiving said second legs in substantially complementary mating relationship, said second legs of said C-shaped channels having outer end portions remote from said second webs which extend transversely to said second legs, and bottom ends portions on said connecting studs received in said bottom channel.

2. A building side wall construction as set forth in claim 1 including a top horizontal channel having a third web and third legs extending downwardly therefrom, and top end portions on said connecting studs received in said top horizontal channel.

3. A building side wall construction as set forth in claim 1 wherein said expanded plastic panels have a thickness which is greater than the distance between said second legs of each of said C-shaped channels, and wherein said opposite end portions include ends which extend transversely to said faces, and wherein at least one of said opposite end portions of each of said panels includes a groove extending inwardly into said panel from one of said ends for receiving a leg of said bottom channel.

4. A building side wall construction as set forth in claim 3 including a top horizontal channel having a third web and third legs extending downwardly therefrom, and top end portions on said connecting studs received in said top horizontal channel, and wherein the other of said opposite end portions of each of said panels includes a second groove extending inwardly into said panel from the opposite end for receiving a third leg of said top channel.

5. A building side wall construction as set forth in claim 1 wherein said expanded plastic panels have a thickness which is greater than the distance between said second legs of each of said C-shaped channels, and wherein said opposite vertical side edge portions include edges which extend transversely to said faces, and wherein certain of said elongated slots extend inwardly into said plastic panels from said edges, whereby at least some of said second legs are received in elongated slots which are located between said inner and outer faces of said panels.

6. A building side wall construction as set forth in claim 5 including a top horizontal channel having a third web and third legs extending downwardly therefrom, top end portions on said connecting studs received in said top horizontal channel, and wherein said opposite end portions of said expanded plastic panels include ends which extend transversely to said faces, and wherein each of said opposite end portions of each of said panels includes a groove extending inwardly into said panel from each end with one of said grooves receiving a first leg of said bottom channel and one of said grooves receiving a third leg of said top channel.

7. A building side wall construction as set forth in claim 6 including center studs of generally U-shaped configuration, and second slot means located between the side edge portions of each of said panels for receiving portions of said center studs in substantially complementary mating relationship for rigidizing said panel between said connecting studs, and end portions on said center studs received in said top and bottom channels.

8. A building side wall construction as set forth in claim 5 wherein certain of said second legs have portions which abut said inner faces of said panels.

9. A building side wall construction as set forth in claim 8 wherein portions of said inner faces which are abutted by said certain of said second legs are recessed so as to cause the outer surfaces of said certain of said second legs to lie substantially flush with adjacent portions of said inner faces.

10. A building side wall construction as set forth in claim 8 including caulking between edge portions of adjacent panels at said outer faces.

11. A building side wall construction as set forth in claim 1 including center studs of generally U-shaped configuration, and second slot means in each of said panels for receiving portions of said center studs in substantially complementary mating relationship for rigidizing said panel between said connecting studs.

12. A building side wall construction as set forth in claim 11 wherein each of said center studs include a center stud web and center stud legs extending outwardly therefrom, and wherein one of said center stud legs lies along a portion of said inner face of said panel, and wherein said portion of said inner face of said panel is recessed so as to cause the outer surfaces of said one of said center stud legs to lie substantially flush with adjacent portions of said inner face.

13. A building side wall construction as set forth in claim 11 including bottom end portions on said center studs received in said bottom channel.

14. A building side wall construction as set forth in claim 13 including a top horizontal channel having a third web and third legs extending downwardly therefrom, top end portions on said connecting studs received in said top horizontal channel, and second top end portions on said center studs received in said top channel.

15. A building wall corner construction comprising first and second horizontal lower channels joined perpendicularly to each other and having first and second channel webs, respectively, and first and second channel legs, respectively, extending upwardly therefrom, first and second rigid expanded plastic panels oriented perpendicularly to each other and each having an inner face and an outer face and a thickness which is greater than the spacing between said channel legs of said first and second channels, and a corner stud for joining said first and second panels, said corner stud comprising a first generally C-shaped channel having a first C-channel web and first C-channel legs extending outwardly therefrom, first and second side edges on said first and second panels, respectively, first groove means in said first side edge for slidably receiving at least one of said first C-channel legs, a second C-shaped channel having C-channel web and second C-channel legs extending outwardly therefrom, said second C-channel web extending substantially perpendicularly to said first C-channel web with one of said second C-channel legs being secured to said first C-channel web, and second groove means in said second panel for slidably receiving said second C-channel web and one of said second C-channel legs.

16. A building wall corner construction as set forth in claim 15 wherein said first and second C-channel legs have outer free ends, and transversely extending extensions on said free ends.

17. A building wall corner construction as set forth in claim 15 wherein said first C-channel web is located along said first side edge of said first panel, and wherein said second channel web extends inwardly into said second panel and is spaced inwardly from said second side edge of said second panel.

18. A building wall corner construction as set forth in claim 15 wherein said second panel includes a backup stud having a first portion received within a backup stud groove within said channel and a second portion extending substantially along said inner face of said second panel proximate the intersection of the inner faces of said first and second panels.

19. A building wall corner construction as set forth in claim 18 wherein said backup stud is of generally C-shaped configuration having a backup web and backup legs extending outwardly therefrom, and wherein said second portion of said backup stud comprises one of said backup legs.

20. A building wall corner construction as set forth in claim 19 wherein a portion of said inner face which extends along said second portion of said backup stud is recessed so as to cause the outer surface of said second portion of said backup stud to lie substantially flush with adjacent portions of said inner face.

21. A building panel comprising a body of expanded plastic having an inner face and an outer face, opposite edge portions on said body, edges on said edge portions extending transversely to said faces, opposite end portions on said body, ends on said end portions extending transversely to said faces, a first elongated groove in each of said opposite edge portions extending inwardly into said body from said edges, a second elongated groove in each of said end portions extending inwardly into said body from said ends, said first and second grooves defining a substantially continuous groove about said body, and stud-receiving groove in said body, said stud-receiving groove being spaced inwardly from said opposite edges.

22. A building panel as set forth in claim 21 wherein said second grooves are closer to said outer face than said first grooves.

23. A building panel as set forth in claim 21 wherein said stud-receiving groove has a first portion which extends inwardly into said body from said inner face, and a second portion within said body which extends transversely to said first portion.

24. A building panel as set forth in claim 21 wherein portions of said inner face proximate said opposite edges are recessed relative to the remainder of said inner face.

25. A building panel as set forth in claim 21 wherein said stud-receiving groove extends substantially parallel to said opposite edges.

26. A building panel as set forth in claim 25 wherein said inner face proximate said stud-receiving groove is recessed relative to adjacent portions of said inner face.

27. A building panel as set forth in claim 21 wherein each of said first elongated grooves has a first portion which extends inwardly into said body in a first direction and a second portion in communication with said first portion and extending transversely thereto.

* * * * *